US006851802B2

(12) United States Patent
Sakakibara et al.

(10) Patent No.: US 6,851,802 B2
(45) Date of Patent: Feb. 8, 2005

(54) IMAGE FORMING DEVICE INCLUDING MECHANISM TO LOCK COVER

(75) Inventors: Akihiro Sakakibara, Toyota (JP); Masato Moribe, Nagoya (JP); Toshio Sugiura, Anjo (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 35 days.

(21) Appl. No.: 10/424,692

(22) Filed: Apr. 29, 2003

(65) Prior Publication Data

US 2003/0206224 A1 Nov. 6, 2003

(30) Foreign Application Priority Data

May 2, 2002 (JP) ..... 2002-130904

(51) Int. Cl.[7] ..... B41J 29/013; B41J 29/00; B41J 2/41

(52) U.S. Cl. ..... 347/108; 347/152; 347/104; 400/693; 400/663; 355/210; 355/200

(58) Field of Search ..... 347/108, 152, 347/170, 222, 263, 2, 3, 104; 400/693, 663; 355/210, 200; D18/55; D14/118

(56) References Cited

U.S. PATENT DOCUMENTS 4,969,010 A * 11/1990 Tamura et al. ..... 355/75
5,268,705 A * 12/1993 Dreinhoff et al. ..... 347/218
5,285,240 A * 2/1994 Kinoshita et al. ..... 399/110
5,353,360 A * 10/1994 Obara ..... 382/321
5,424,760 A * 6/1995 Wirth et al. ..... 347/222
5,532,826 A * 7/1996 Miyao et al. ..... 358/296
D377,370 S * 1/1997 Escobedo et al. ..... D18/55
5,689,775 A * 11/1997 Marumoto ..... 399/121
6,252,619 B1 * 6/2001 Ueda et al. ..... 347/138
6,588,624 B1 * 7/2003 Connors et al. ..... 220/827
6,768,502 B2 * 7/2004 Milton ..... 347/197
6,783,231 B1 * 8/2004 Kim ..... 347/108

FOREIGN PATENT DOCUMENTS

JP 63315280 A * 12/1988 ..... B41J/29/46
JP 09069016 A * 3/1997 ..... G06F/1/16

* cited by examiner

*Primary Examiner*—Lamson Nguyen
*Assistant Examiner*—Leonard Liang
(74) *Attorney, Agent, or Firm*—Oliff & Berridge PLC

(57) ABSTRACT

When a cover body at a closing position is pulled up with respect to a main body, then a lock lever attached to the cover body abuts against a hook body of the main body, regulating a rattle of the cover body with respect to the main body. When a user lifts up a multi-function peripheral device by grabbing the lock lever, the lock lever comes into engagement with the hook body, thereby preventing the lock lever from opening.

10 Claims, 15 Drawing Sheets

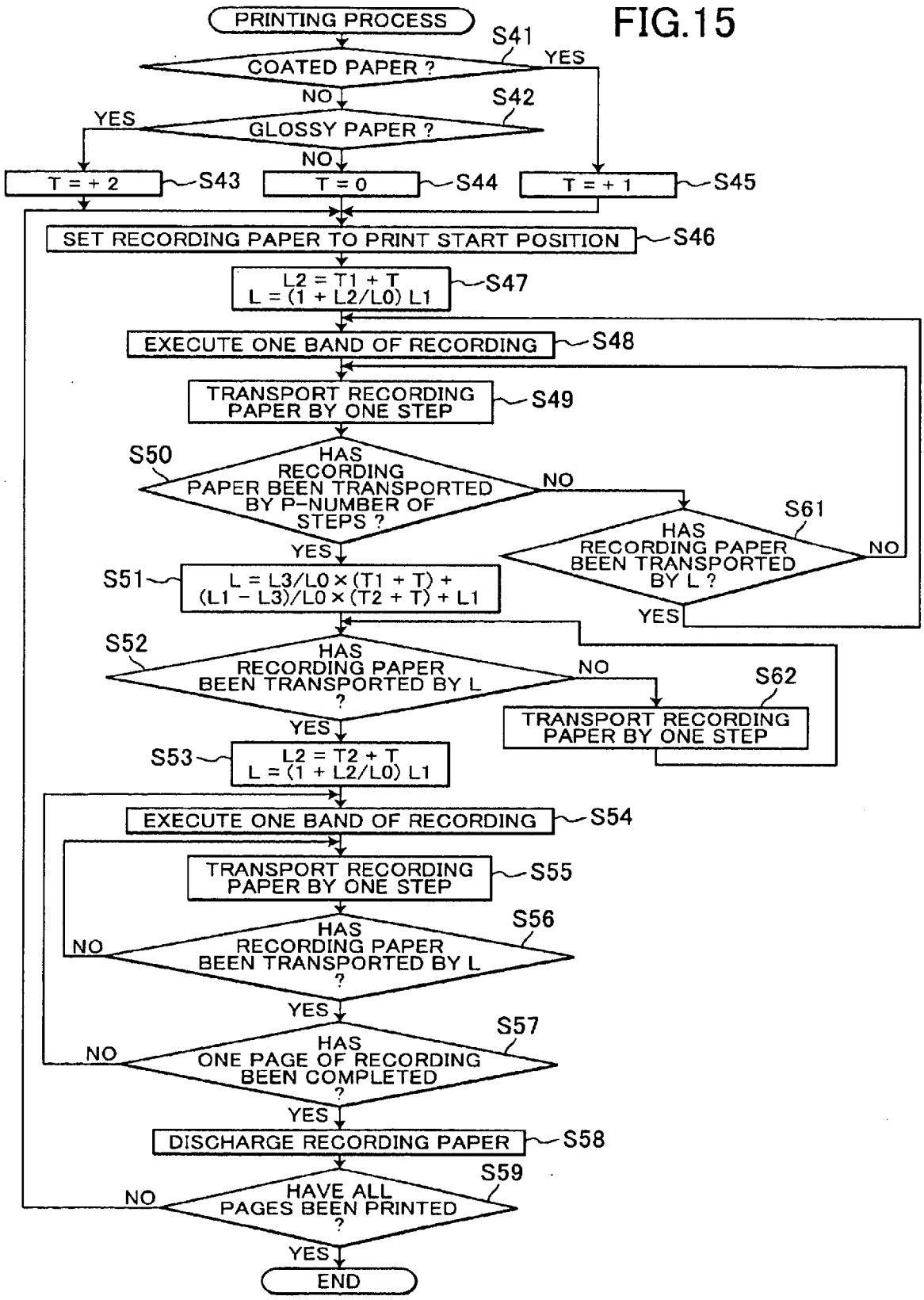
FIG.15
PRINTING PROCESS
S41
COATED PAPER ?
YES
NO
S42
GLOSSY PAPER ?
YES
NO
T = + 2
S43
T = 0
S44
T = + 1
S45
SET RECORDING PAPER TO PRINT START POSITION
S46
L2 = T1 + T
L = (1 + L2/L0) L1
S47
EXECUTE ONE BAND OF RECORDING
S48
TRANSPORT RECORDING PAPER BY ONE STEP
S49
S50
HAS RECORDING PAPER BEEN TRANSPORTED BY P-NUMBER OF STEPS ?
NO
YES
S61
HAS RECORDING PAPER BEEN TRANSPORTED BY L ?
NO
YES
S51
L = L3/L0 × (T1 + T) + (L1 − L3)/L0 × (T2 + T) + L1
S52
HAS RECORDING PAPER BEEN TRANSPORTED BY L ?
NO
S62
TRANSPORT RECORDING PAPER BY ONE STEP
YES
S53
L2 = T2 + T
L = (1 + L2/L0) L1
EXECUTE ONE BAND OF RECORDING
S54
TRANSPORT RECORDING PAPER BY ONE STEP
S55
S56
HAS RECORDING PAPER BEEN TRANSPORTED BY L ?
NO
YES
S57
HAS ONE PAGE OF RECORDING BEEN COMPLETED ?
NO
YES
DISCHARGE RECORDING PAPER
S58
S59
HAVE ALL PAGES BEEN PRINTED ?
NO
YES
END

IMAGE FORMING DEVICE INCLUDING MECHANISM TO LOCK COVER

BACKGROUND OF THE INVENTION

1. Field of the Invention

The present invention relates to an image forming device, and more specifically to an image forming device which is reduced in rattle of a cover body with respect to a main body in a vertical direction and which prevents the cover body from accidentally opening when the image forming device is lifted up by grabbing the cover body.

2. Description of the Related Art

There has been provided an image forming device that includes a main body provided with a printing unit for printing images on a recording sheet and a cover body provided with a reading unit for reading images from original documents. The cover body is disposed above and pivotally supported on the main body via a hinge so that cover body can move to its opening position by pivoting upward and to its closing position by pivoting downward.

FIG. 17 is a magnified partial view showing a main body 510 and a cover body 520 of a conventional image forming device. When the cover body 520 is closed, a pulling spring 530 urges a lever 521 of the cover body 520 toward a wall 511 of the main body 510 in a direction opposite to a direction indicated by an arrow X. A tip 522 of the lever 521 and a tip 512 of the wall 511 are in vertical confrontation with each other with a small gap therebetween. Therefore, rattle of the cover body 520 and the main body 510 in the vertical direction is confined within this gap. In order to open the cover body 520, a user slides the lever 521 in the direction X against the urging force of the pulling spring 530 to displace vertical overlap of the tip 522 of the lever 521 and the tip 512 of the wall 511. Then, the user pivots the cover body 520 upward to its opening position.

This image forming device includes handles (not shown) disposed on both sides of the main body 510, enabling the user to carry around the image forming device by grabbing the handles. However, because the cover body 520 projects outward from the side of the main body 510, the user likely grabs the cover body 520 rather than the handles when carrying the image forming device.

If the user lifts up the image forming device by grabbing the lever 521 of the cover body 520, then the lever 521 slides in the direction X to cause displacement of vertical overlap of the tip 522 of the lever 521 and the tip 512 of the wall 511, opening the cover body 520 the instant the image forming device is lifted.

The impact of opening of the cover body 520 may cause the user to drop the image forming device, or may cause the main body 510 to pivot about the hinge and bang into the user. Also, if the user lifts up the image forming device by grabbing the cover body 520 opened with the main body 510 hanging therefrom via the hinge, an excessive load is exerted on the hinge. This may sever the main body 510 from the cover body 520, causing a danger that the severed main body 510 drops onto the user to cause an injury.

SUMMARY OF THE INVENTION

In the view of foregoing, it is an object of the present invention to overcome the above problems, and also to provide an image forming device which is reduced in rattle of a cover body and which prevents the cover body from accidentally opening when a user lifts up the device by grabbing the cover body.

In order to attain the above and other objects, the present invention provides an image forming device including a main body, a cover body, a first engagement member, a second engagement member, and an urging member. The cover body is pivotally supported on the main body, and the cover body pivotally moves between a closing position and an opening position. The first engagement member is provided to the main body. The second engagement member is slidably attached to the cover body and detachably engageable with the first engagement member. The urging member urges the second engagement member toward the main body when the cover body is at the closing position. When the cover body is at the closing position, the second engagement member is movable with respect to the main body between at least a contact position and an engagement position. The second engagement member at the contact position confronts the first engagement member, and the second engagement member at the engagement position engages the first engagement member. The second engagement member moves from the contact position to the engagement position when the second engagement member slides away from the main body.

BRIEF DESCRIPTION OF THE DRAWINGS

In the drawings:

FIG. 15 is a flowchart representing a printing process according to a third embodiment of the present invention;

PREFERRED EMBODIMENTS OF THE PRESENT INVENTION

Next, preferred embodiments of the present invention will be described with reference to the accompanying drawings.

Figure 1:
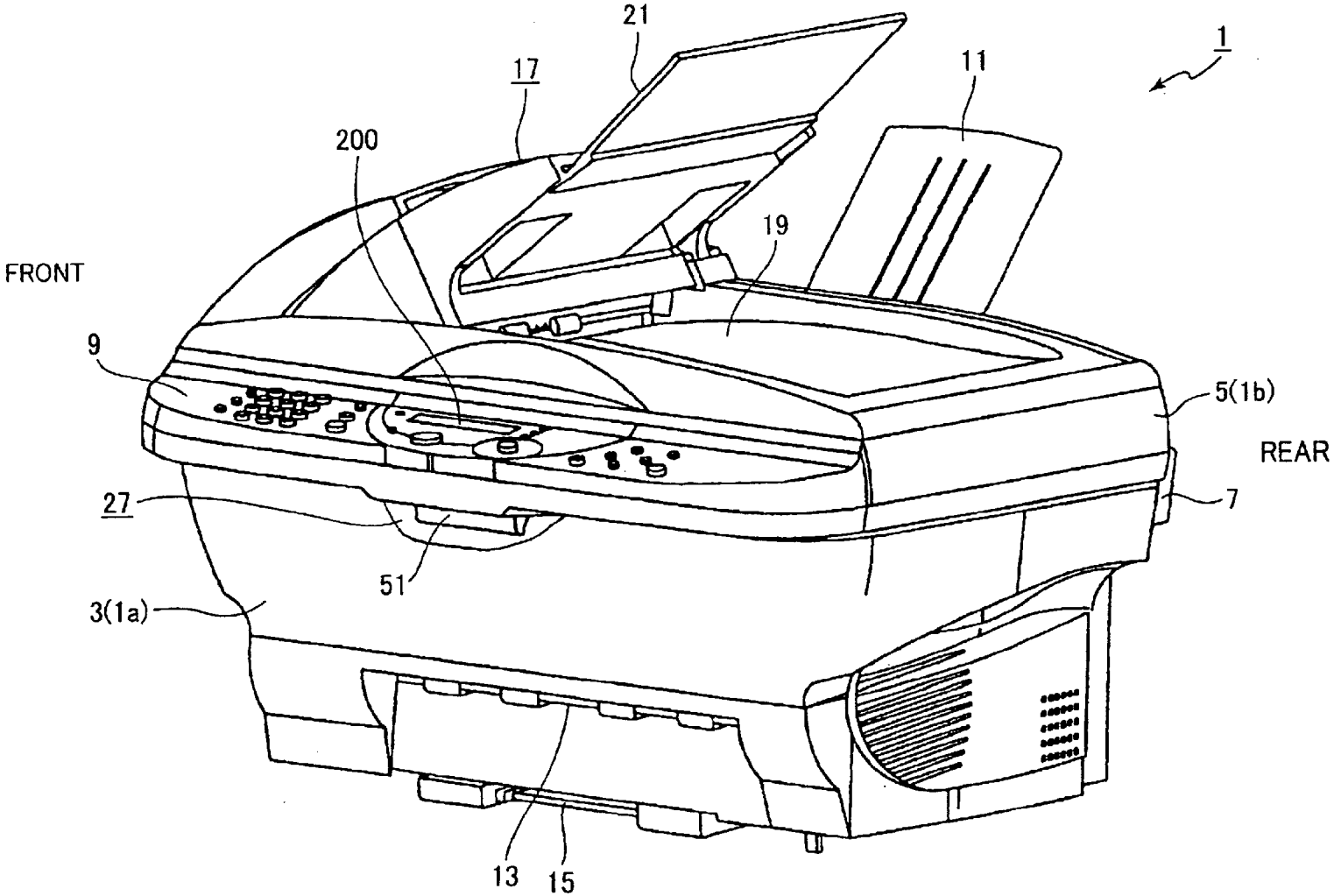
FIG. 1 is a perspective side view of a multi-function peripheral device according to an embodiment of the present invention.

FIG. 1 is a perspective outside view of a multi-function peripheral device 1 serving as an image forming device. The multi-function peripheral device 1 of the present embodiment is a single device equipped with a telephone function, a printer function, a copier function, and a scanner function in addition to a facsimile function.

Figure 2:
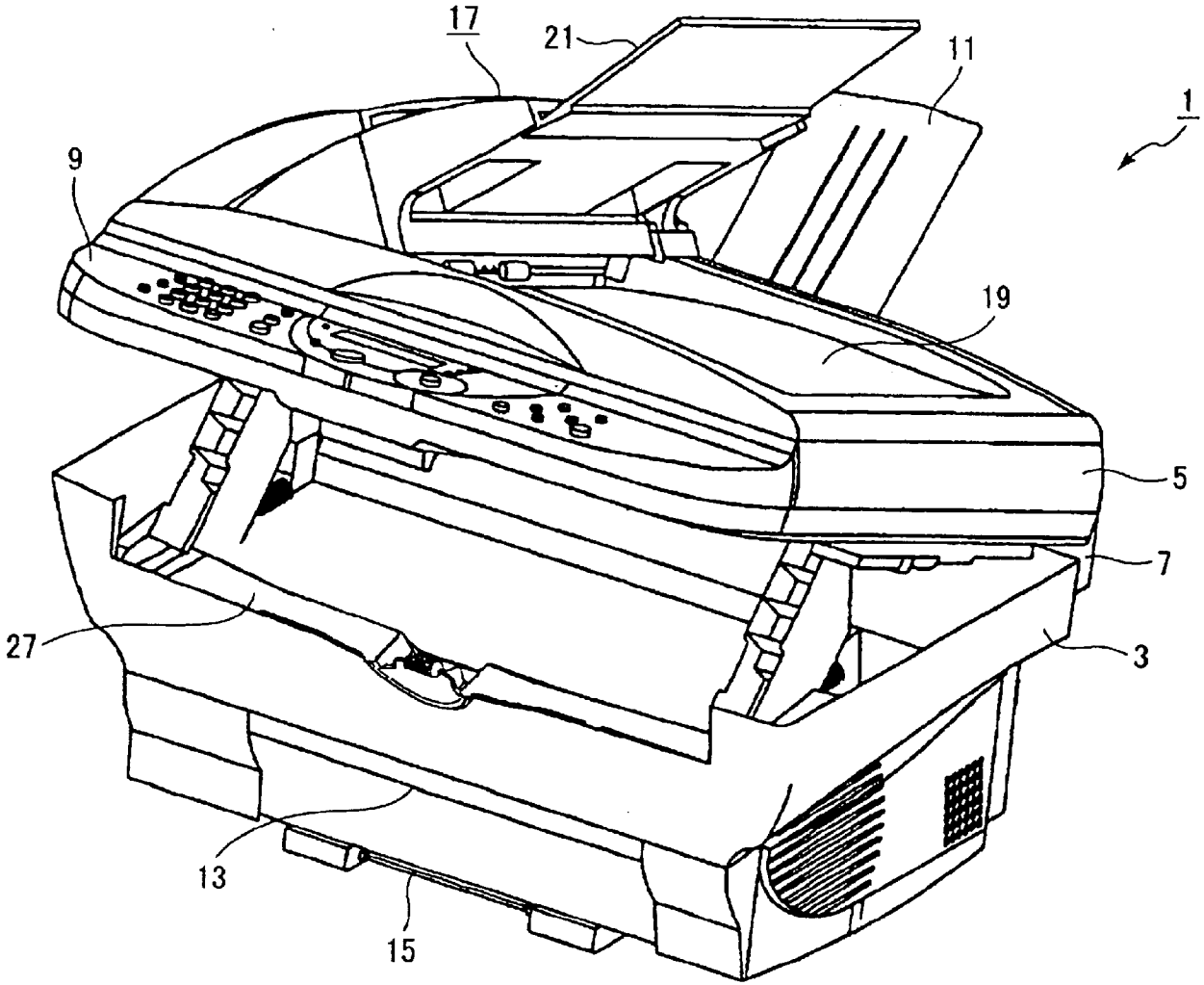
FIG. 2 is a perspective side view of the multi-function peripheral device with a cover body opened.

As shown in FIG. 1, the multi-function peripheral device 1 includes a main body 3 and a cover body 5. The main body 3 is incorporated with an ink-jet printer unit 1*a*, and the cover body 5 is incorporated with an image scanning unit 1*b*. A hinge 7 provided on the rear side of the multi-function peripheral device 1 axially and pivotally supports the main body 3 and the cover body 5. With this configuration, the cover body 5 pivotally moves upward and downward between an opening position shown in FIG. 2 and a closing position shown in FIG. 1. An operation panel 9 is disposed on the front side of the cover body 5. The operation panel 9 has a liquid crystal display (LCD) 200 in its center.

A sheet feeding tray 11 is disposed on the rear side of the multi-function peripheral device 1 to support a stack of recording sheets, and a discharge port 13 is formed in the front side of the multi-function peripheral device 1. A sheet discharge tray 15 is housed inside the multi-function peripheral device 1 below the discharge port 13 such that the sheet discharge tray 15 is pulled out as the needed. The ink-jet printer unit 1*a* fetches a recording sheet from the sheet feeding tray 11, prints images on the recording sheet, and discharges the recording sheet through the discharge port 13 onto the pulled-out sheet discharge tray 15.

The image scanning unit 1*b* is a flat-bed type scanner. Although not shown in the drawings, the image scanning unit 1*b* includes a platen glass that supports an original thereon and a linear image scanner that reads images from the original while moving across the original supported on the platen glass. On the left side of the image scanning unit 1*b*, an Auto Document Feeder (ADF) mechanism 17 is disposed to successively read images from plural of original documents. The ADF mechanism 17 fetches original documents one at a time from an original feeding tray 19, passes the original document above the image sensor so that the image sensor can read images without moving across the platen glass, and discharges the original documents onto an original discharge tray 21.

As shown in FIG. 1, a bridge member 27 is disposed on the front side of the main body 3. Also, a lock lever 51 is slidably attached to the cover body 5 at a front side. The bridge member 27 engages the lock lever 51 to keep the cover body 5 at the closing position.

Figure 3:
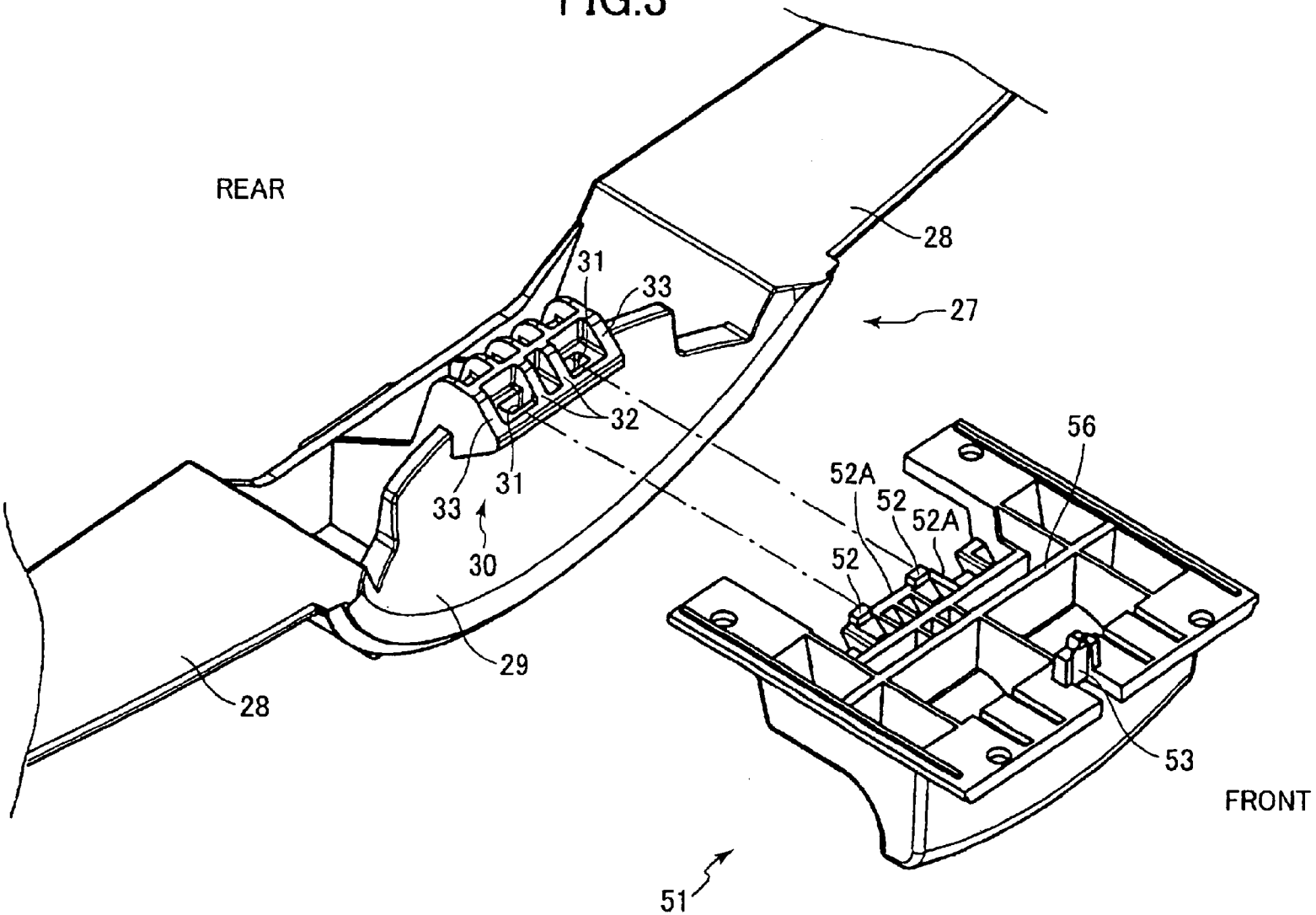
FIG. 3 is a perspective view showing a bridge member bridge member and a lock lever of the multi-function peripheral device.

FIG. 3 is a perspective view showing the bridge member 27 and the lock lever 51. As shown in FIG. 3, the bridge member 27 has a pair of flat-shaped side plates 28, a concave portion 29 sandwiched between the side plates 28, and a hook body 30 disposed in an upper middle part of the concave portion 29. The center of the concave portion 29 is curved downward. A portion of the hook body 30 projects outward (frontward) opposite to the main body 3 side and is formed with a pair of engaging holes 31. A pair of reinforcing ribs 32 are formed between the engaging holes 31, and a pair of reinforcing ribs 33 are formed both sides of the engaging holes 31 so as to improve the strength of the hook body 30. Because the hook body 30 is disposed in the upper middle part of the curved concave portion 29, a front tip of the hook body 30 locates rear of a front edge of the bridge member 29. Therefore, even when the cover body 5 is in the opening position to expose the hook body 30, the hook body 30 is prevented from breakage by catching on something.

The lock lever 51 includes a pair of projections 52, a claw 53, a stopper wall 56, and a plurality of reinforcing ribs 52A surrounding the projections 52. The projections 52 engage the engaging holes 31 of the hook body 30 so as to keep the cover body 5 at the closing position in a manner described later.

Here, if a user lifts up the multi-function peripheral device 1 by grabbing the cover body 5 while the projections 52 are in engagement with the engaging holes 31, a relatively large load is exerted on an engaging portion where the projections 52 engage the engaging holes 31. If there is only one engaging hole 31, the engaging hole 31 needs to be larger in its size, reducing the strength of the surrounding engaging portion of the hook body 30. In this case, the hook body 30 could be broken by the weight of the main body 3 when such a large load is exerted on the engaging portion. However, according to the present embodiment, because two engaging holes 31 instead of one hole are formed, it is possible to reduce the size of each engaging hole 31, thereby improving the strength of the hook body 30 surrounding the engaging holes 31. Needless to say, the number of the engaging holes 31 and the projections 52 is not limited to two and may be three or more.

Further, because the reinforcing ribs 32 and 33 are provided to improve the strength of the hook body 30 as described above, breakage of the hook body 30 can be prevented. Moreover, the reinforcing ribs 52A of the lock lever 51 make the surroundings of the projections 52 thick and give enough strength to the projections 52.

Figure 4:
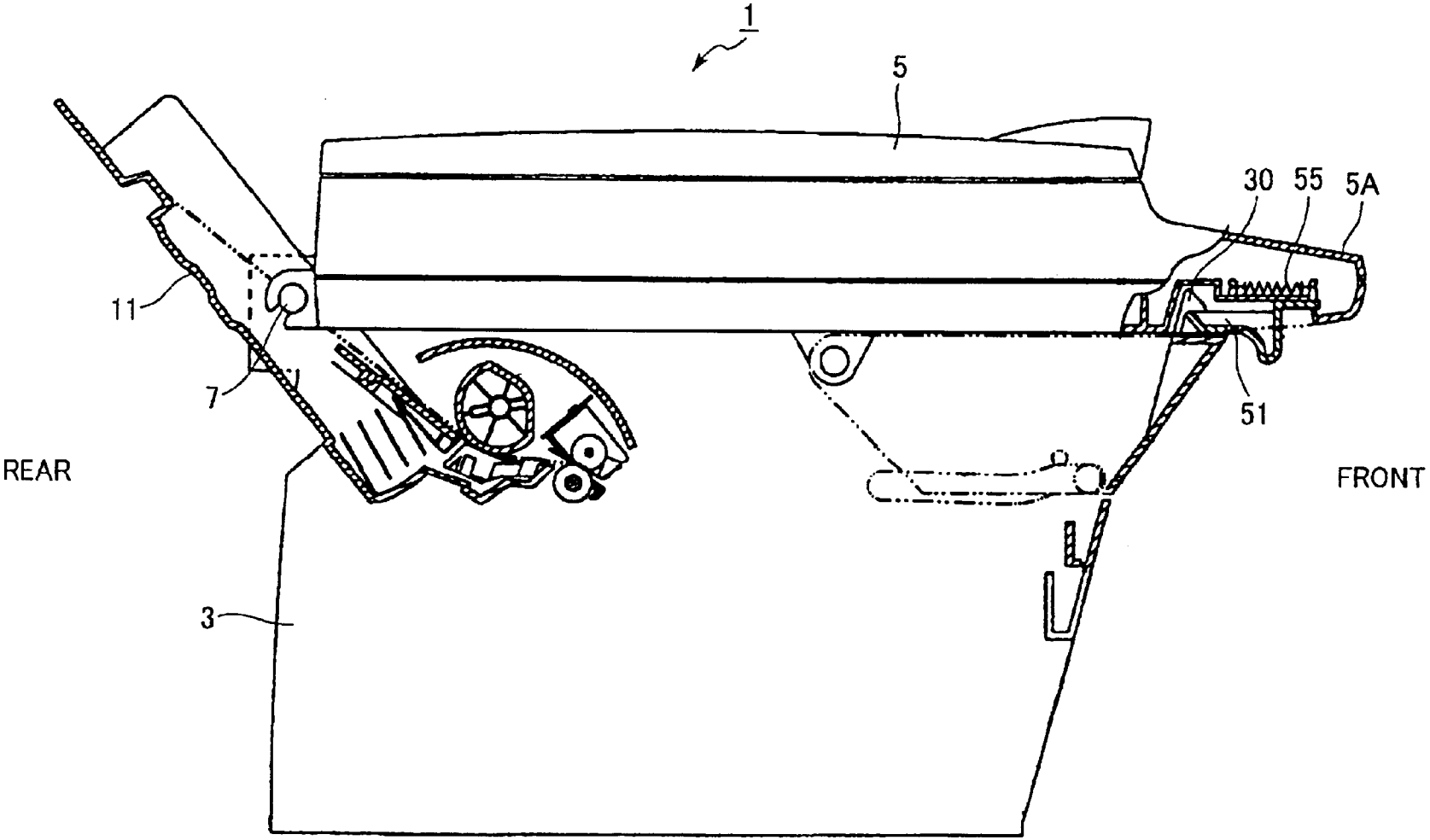
FIG. 4 is a cross-sectional side view of the multi-function peripheral device.

FIG. 4 shows a positional relationship between the hook body 30 and the lock lever 51. As shown in FIG. 4, the cover body 5 has a protruding portion 5A protruding frontward from the main body 3, and the lock lever 51 is attached to the protruding portion. This motivates a user to grab the cover body 5 with his/her hand on the lock lever 51 when carrying the multi-function peripheral device 1.

Figure 5:
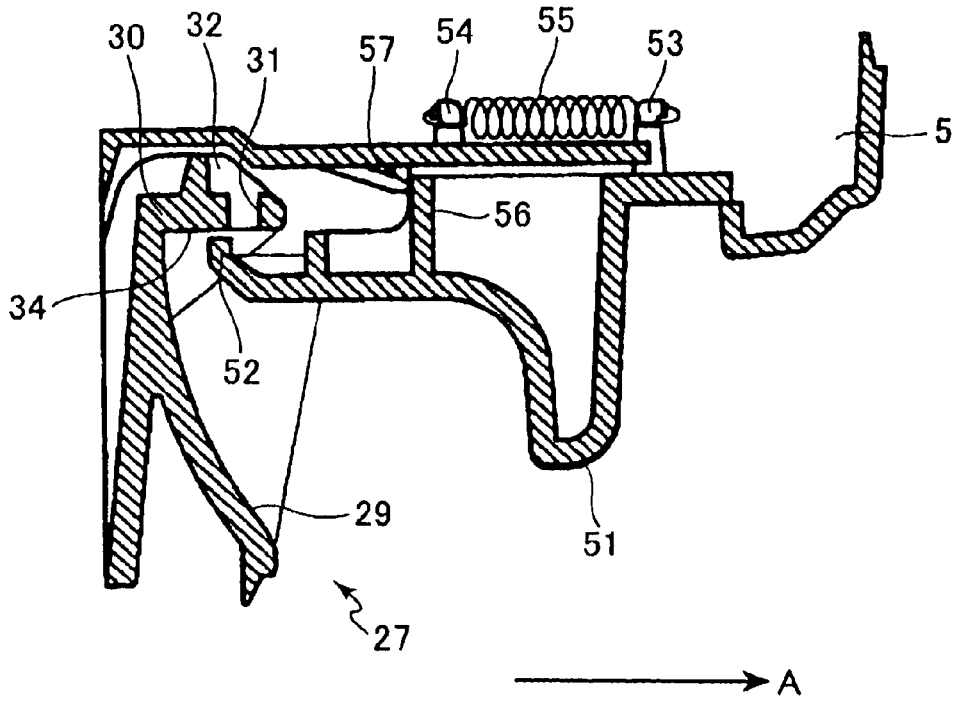
FIG. 5 is an enlarged cross-sectional side view of the hook body and the lock lever at a contact position.
Figure 6:
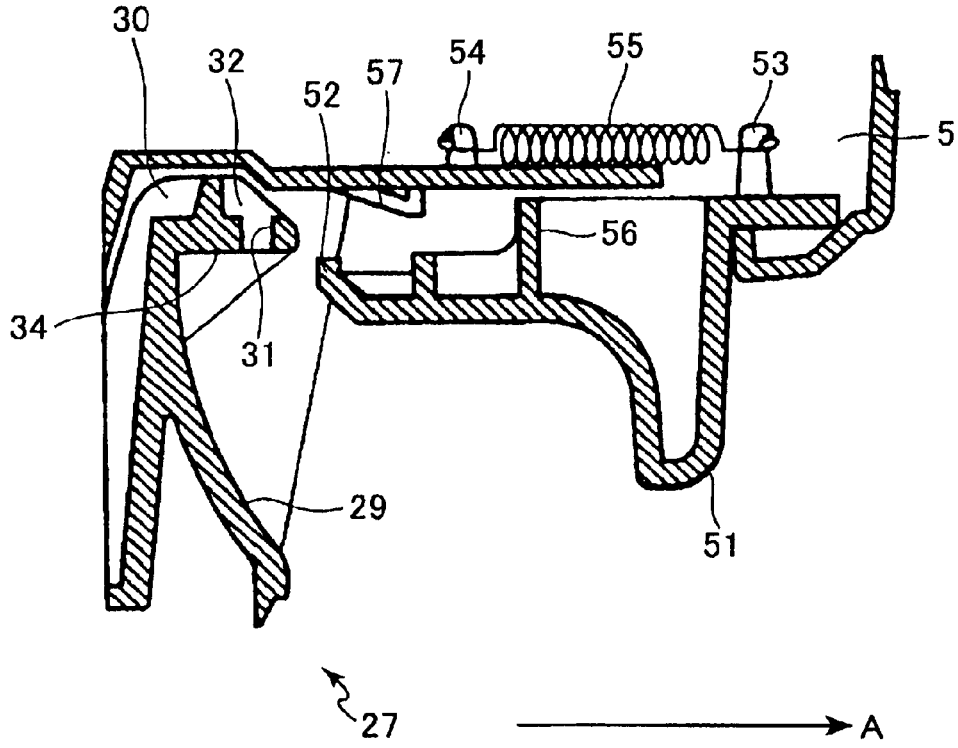
FIG. 6 is an enlarged cross-sectional side view of the hook body and the lock lever at a releasing position.
Figure 7:
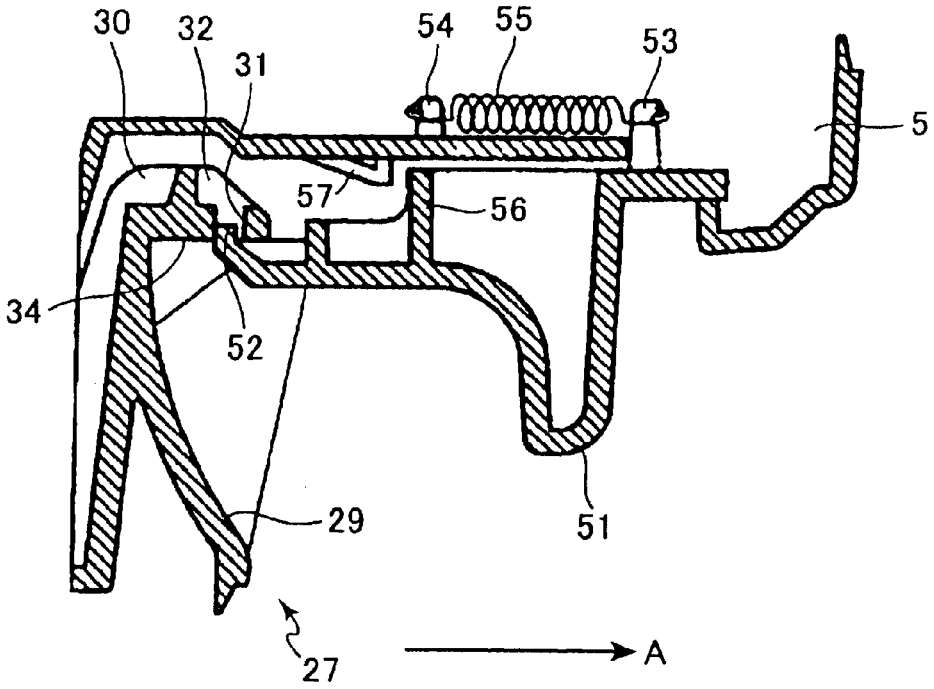
FIG. 7 is an enlarged cross-sectional side view of the hook body and the lock lever at an engagement position.

When the cover body 5 is at the closing position, the lock lever 51 is slidingly movable among a contact position shown in FIG. 5, a releasing position shown in FIG. 6, and an engaging position shown in FIG. 7.

Referring to FIG. 5, a compression spring 55 is looked on the claw 53 provided to the lock lever 51 and on a claw 54 provided to the cover body 5. The compression spring 55 urges the lock lever 51 toward the main body 3 side in a direction opposite to the one indicated by an arrow A. This urging force slides the lock lever 51 toward the main body 3 until the stopper wall 56 of the lock lever 51 abutments a stopping projection 57 of the cover body 5. In this manner, the lock lever 51 is located at the contact position while urged toward the main body 3.

When the lock lever 51 is at the contact position as shown in FIG. 5, a planar portion 34 of the hook body 30, located nearer to the main body 3 than the engaging holes 31 on the hook body 30, confronts the projections 52 of the lock lever 51 from the above. No vertical gap is defined between the planar portion 34 and the projections 52. If any, the gap is limited within a narrow range caused due to manufacture or assemble error. When the cover body 5 is pulled upward in this condition, the projections 52 abut the planar portion 34 to regulate the upward movement of the cover body 5 with respect to the main body 3. In this manner, the cover body 5 is maintained at the closing position, and rattle of the cover body 5 and the main body 3 in the vertical direction is reduced.

In order to move the cover body 5 to the opening position from the closing position, a user slides the lock lever 51 in the direction A against the urging force of the pulling spring 55 to the releasing position shown in FIG. 6, where the projections 52 no longer vertically overlap with the hook body 30. Then, the user pivotally moves the cover body 5 about the hinge 7 upward to the opening position. In this manner, the cover body 5 is opened reliably and securely.

The lock lever 51 at the contact position is brought to the engaging position of FIG. 7 when the user lifts up the multi-function peripheral device 1 with his/her hand on the lock lever 51. That is, if the lock lever 51 at the contact position of FIG. 5 is lifted up by the user, the lock lever 51 slides in the direction A against the urging force of the pulling spring 55 with respect to the main body 3. At the same time, the lock lever 51 is pulled upward with respect to the main body 3. As a result, the projections 52 slide on the planar portion 34 and then enter and engage the engaging holes 31. In this manner, the lock lever 51 engages the hook body 30. This engagement between the lock lever 51 and the hook body 30 prevents the lock lever 51 from further sliding in the direction A to the releasing position. Therefore, even if the user lifts up the multi-function peripheral device 1 with his/her hand on the cover body 5 (lock lever 51), the cover body 5 is maintained at the closing position.

As described above, according to the present embodiment, the rattle of the cover body 5 and the main body 3 is regulated small when the cover body 5 is at the closing position. Also, lifting up the multi-function peripheral device 1 by a user with his/her hand on the lock lever 51 does not cause the cover body 5 to open because the lock lever 51 and the hook body 30 engage with each other. Therefore, it is possible to prevent breakage of the multi-function peripheral device 1 and injury on the user.

Accordingly, the user can carry the multi-function peripheral device 1 with the cover body 5 closed by grabbing the cover body 5 (lock lever 51) Also, because the hook body 30 and the projections 52 have improved strength to support the main body 3 while the multi-function peripheral device 1 is carried, the multi-function peripheral device 1 will not be broken even if the user carries the multi-function peripheral device 1 by grabbing the cover body 5 closed.

Figure 8:
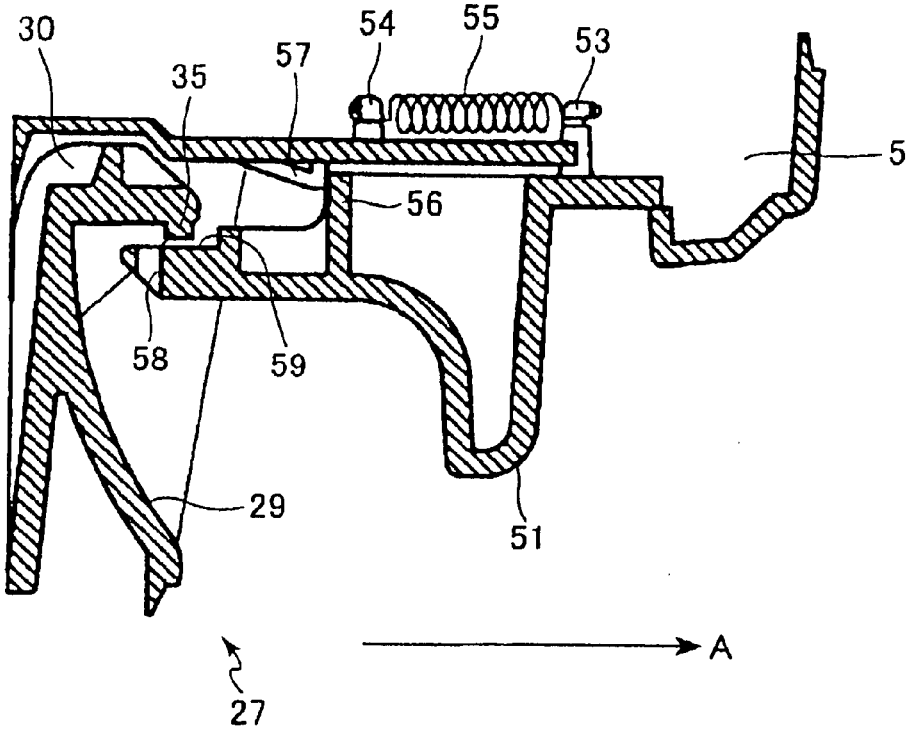
FIG. 8 is an enlarged cross-sectional side view of a hook body and a clock lever according to a modification of the embodiment.

FIG. 8 shows a bridge member 27 and a lock lever 51 according to a modification of the above embodiment. In the above embodiment, the projections 52 are formed to the lock lever 51, and the planar portion 34 and the engaging holes 31 are formed to the hook body 30. However, in this modification, the lock lever 51 has a planar portion 59 and hole portions 58, and the hook body 30 has projections 35. The hole portions 58 are nearer to the hook body 30 than the planar portion 59. In this configuration also, the same effects as in the above embodiment can be provided. Here, in lieu of the engaging holes 31, 58, engaging grooves could be used.

Next, the ink-jet printer unit 1*a* of the present embodiment will be described. The ink-jet printer unit 1*a* is for printing images on a recording sheet based on data received via the copying function or the facsimile function.

Figure 9:
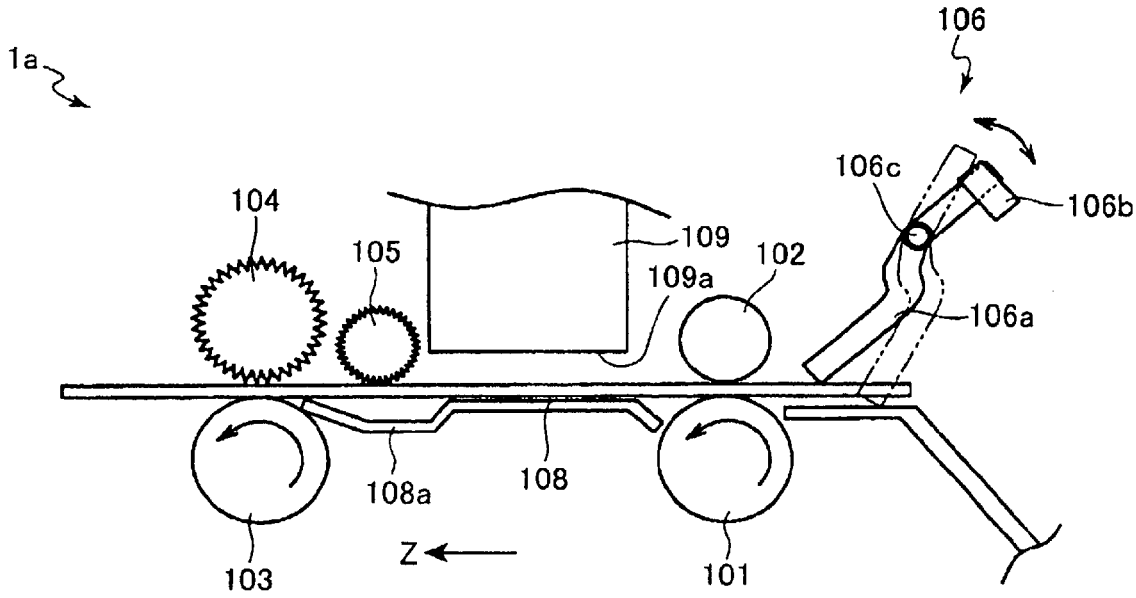
FIG. 9 is a plan view of main components of the multi-function peripheral device.

As shown in FIG. 9, the ink-jet printer unit 1*a* includes a transport roller 101, a pinch roller 102, a discharge roller 103, spurs 104 and 105, a rear edge sensor 106 for detecting a rear edge of a recording sheet, a platen 108, and an ink-jet head 109. A recording sheet is transported in a sheet transport direction indicated by an arrow Z.

The rear edge sensor 106, the pinch roller 102, the ink-jet head 109, the spur 105, and the spur 104 are arranged in this order from the upstream side to the downstream side in the sheet transport direction Z. The pinch roller 102 is disposed in confrontation with the transport roller 101. The discharge roller 103 is disposed in confrontation with the spur 104. The platen 108 is disposed beneath the ink-jet head 109 to confront a nozzle surface 109*a* of the ink-jet head 109.

The transport roller 101 is driven to rotate by a transport motor 110 (FIG. 10) so as to transport a recording sheet in the sheet transport direction Z while sandwiching the same between the transport roller 101 and the pinch roller 102. In this manner, the recording sheet is supplied to the ink-jet head 109, which performs printing on the recording sheet with ink.

The discharge roller 103 is driven to rotate by the transport motor 110 so as to transport the recording sheet in the sheet transport direction Z while sandwiching the same between the discharge roller 103 and the spur 104. At this time, an ink image printed on a printed surface of the recording sheet comes into contact with the spur 104. Because the ink image does not get dry immediately after printed, the spurs 104 and 105 are used in the present embodiment so as to reduce contact area that contacts the printed surface. That is, if the ink image contacts a roller having a large contact area before the image get dry, the printed image may be blurred, crinkled, or transferred, degrading printing quality. However, because each of the spurs 104 and 105 used in the present embodiment has only a small contact area, such problems can be prevented.

Figure 10:
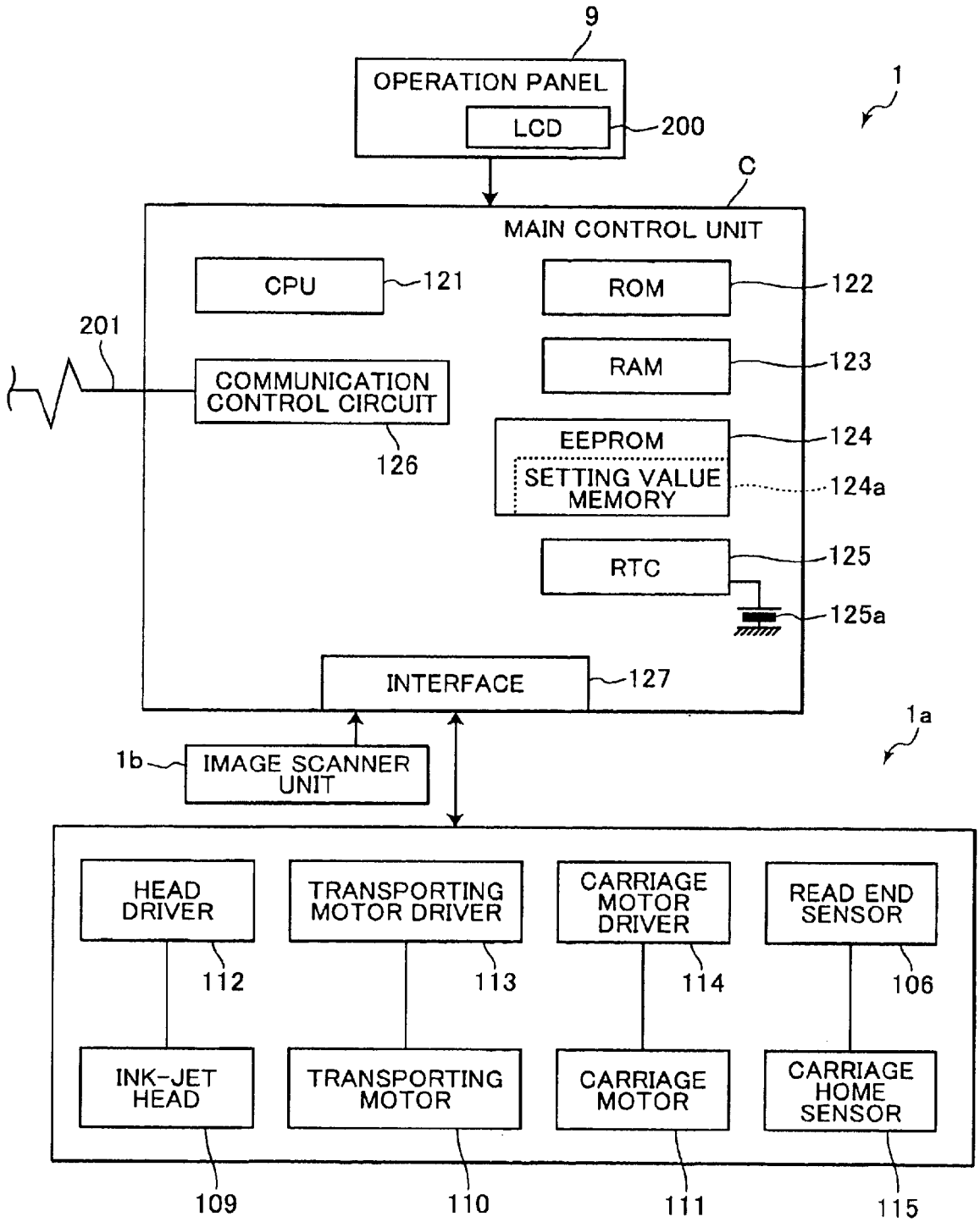
FIG. 10 is a block diagram showing an electrical structure of the multi-function peripheral device.

Although not shown in the drawings, the ink-jet head 109 is mounted on a carriage that is driven by a carriage motor (CR motor) 111 shown in FIG. 10 to move in a lateral direction perpendicular to the sheet transport direction Z. The nozzle surface 109*a* has a length of about 1 inch with respect to the sheet transport direction Z, and is formed with N-number of nozzles arranged in the sheet transport direction Z. Ink cartridges (not shown) each filled with one of four colors of ink, namely cyan, magenta, yellow, and black, supply the ink-jet head 109 with the ink, and the ink-jet-head 109 ejects the ink from the nozzle surface 109*a* toward the recording sheet.

With this configuration, the ink-jet head 109 prints ink images on the recording sheet based on read data while moving across the recording sheet in the lateral direction. Because the N-number of nozzles are arranged in the sheet transport direction Z as described above, the ink-jet head 109 prints N-dot worth of image with respect to the sheet transport direction Z at the maximum while a single lateral movement (1 band) of the ink-jet head 109.

Transport of the recording sheet is performed in conjunction with printing by the ink-jet head 109. That is, the transport of the recording sheet and the printing are performed in alternation. The transport amount of the recording sheet while a single transport operation is predetermined based on resolution and nozzle pitch and maintained while printing on the same recording sheet. The transport amount of the recording sheet while a single transport operation is equal to a width of an image printed during a single lateral movement of the ink-jet head 109 if the resolution of the ink-jet head 109 is equal to the resolution of the image. On the other hand, the transport amount of the recording sheet while a single transport operation differs from a width of an image printed during a single lateral movement of the ink-jet head 109 if the resolution of the ink-jet head 109 differs from the resolution of the image, that is, if interlace printing is performed.

In this embodiment, a pulse power is applied to the transport motor 110 to rotate the transport roller 101 and the discharge roller 103. The discharge roller 103 can transport a recording sheet per pulse by an amount larger than a transport amount of the transport roller 101 per pulse. However, because the transport roller 101 and the pinch roller 102 sandwich the recording sheet with a greater force than the discharge roller 103 and the spur 104, the sheet transport force is controlled mainly by the transport roller 101, and the discharge roller 103 slips on the recording sheet and gives the recording sheet a tensile force.

The platen 108 serves to guide the recording sheet from the transport roller 101 to the discharge roller 103. The recording sheet is transported through a gap between the platen 108 and the ink-jet head 109. The platen 108 has a concave portion 108*a* downstream of the ink-jet head 109. If the recording sheet remains wet with ink for a long period of time, then the recording sheet is curled in a convex shape. This causes a possibility that the printed surface of the recording sheet contacts the ink-jet head 109, smearing the recording sheet with ink. The concave portion 108*a* of the present embodiment keeps a curled recording sheet away from the nozzle surface 109*a* of the ink-jet head 109. Therefore, the recording sheet does not touch the ink-jet head 109 even if the recording sheet is curled.

The rear edge sensor 106 includes a lever 106*a* and a sensor portion 106*b*. The sensor portion 106*b* is a rod-like arm rotatable about an axis 106*c* between a normal position indicated by a dotted chain line in FIG. 9 and a rotated position indicated by a solid line. When the lever 106*a* is at the rotated position, a lower tip of the lever 106*a* locates at a predetermined rear-edge detection position. Usually, the lever 106*a* is located at the normal position where the lower tip of the lever 106*a* locates below a sheet feed path along which a recording sheet is transported.

When a recording sheet is supplied to the sheet feed path, the recording sheet scoops up and moves the lower tip of the lever 106*a* in the sheet transport direction Z so as to bring the lever 106*a* to the rotated position. Then, the lever 106*a* is maintained at the rotated position as long as the recording sheet is present at the rear-edge detection position. The length and the position of the lever 106*a* are determined so that the lower tip of the lever 106*a* comes to the rear-edge detection position that is upstream of the transport roller 101 by a predetermined distance when the recording sheet is supplied.

The sensor portion 106*b* is a photo interrupter including a light emitting diode and a photo transistor (not shown), between which an upper end of the lever 106*a* locates. The amount of light received by the photo transistor varies depending on whether the lever 106*a* is at the normal position or at the rotated position.

With this configuration, when a recording sheet is present at the rear-edge detection position and so the lever 106*a* locates at the rotated position, then the sensor portion 106*b* outputs an ON signal. However, when a rear edge of the recording sheet passes by the rear-edge detection position and the lever 106*a* returns to the normal position, then the sensor portion 106*b* outputs an OFF signal. In this manner, it is possible to detect the presence and absence of a recording sheet at the rear-edge detection position.

FIG. 10 is a block diagram showing the electrical structure of the multi-function peripheral device 1. The multi-function peripheral device 1 includes a main control unit C having a central processing unit (CPU) 121, a read only memory (ROM) 122, a random access memory (RAM) 123, an electrically erasable read only memory (EEPROM) 124, a real time clock (RTC) 125, a communication control circuit 126, and an interface unit 127. The main control unit C controls each process performed in the multi-function peripheral device 1. The CPU 121 performs overall control of the multi-function peripheral device 1 to carry out data communication, such as a facsimile operation and a telephone operation, a printing operation, and a copying operation.

The ROM 122 stores control programs executed by the CPU 121, various fixed values, and the like. The CPU 121 executes processes in accordance with the control programs stored in the ROM 122. A program for a printing process executed in the multi-function peripheral device 1 is stored as one of the control programs in the ROM 122. In printing process, the sheet transport speed of a recording sheet is changed in accordance with the rear edge position of the recording sheet as well as the resolution. The target transport speed of the recording sheet varies among 480 pps, 3,800 pps, 10,000 pps depending on the rear edge position of the recording sheet. These amounts of the target transport speed are stored as fixed values in the ROM 122 in advance. Details of the printing process will be described later.

The RAM 123 is for storing various data temporarily. Decoded facsimile data is temporarily stored in a predetermined area of the RAM 123. The facsimile data stored in the RAM 123 is printed on a recording sheet by the ink-jet printer unit 1*a* and then erased from the RAM 123. When the facsimile data is image data, the data size is large in general. However, the facsimile data is erased after printed and therefore the RAM 123 can be used effectively.

The EEPROM 124 is a rewritable non-volatile memory. Data stored in the EEPROM 124 is kept after the power is turned OFF. The EEPROM 124 has a setting value memory 124*a* for non-volatile storing of various data and setting values that are set or registered by a user.

The setting value memory 124*a* stores, as default values, various values required by the ink-jet printer unit 1*a* to perform printing operations. The values include, for example, a threshold value for binarization process, an original point of the carriage, and correction values to accommodate various recording sheet materials. These values are set prior to shipment, and a user can change these values to adjust printing conditions so as to suit individual use conditions and user's preferred print finish.

The user can write data into the EEPROM 124 by operating keys of the operation panel 9. The procedure and the like for this operation are displayed on the LCD 200 of the operation panel 9.

The RTC 125 is an integrated circuit (IC) for counting time: year, date, day, hour, minute, and second. The RTC 125 is connected to a battery circuit 125*a* that supplies a backup voltage to the battery circuit 125*a* when the main power of the multi-function peripheral device 1 is turned OFF. Therefore, the RTC 125 can continue to count time even when the power of the multi-function peripheral device 1 is OFF.

The communication control circuit 126 is a circuit that enables the multi-function peripheral device 1 to perform data communication in a telephone operation and a facsimile operation. Although not shown in the drawings, the communication control circuit 126 has a network control unit (NCU) for controlling lines, an audio LSI, a modem, a buffer, an encoding portion, a decoding portion, and the like. The modem is a modulator-demodulator for converting digital data to analog data and vice versa.

The multi-function peripheral device 1 is connected to a telephone line 201 through the communication control circuit 126. The multi-function peripheral device 1 sends and receives data to and from a remote device via a switchboard (not shown) provided on the telephone line 201.

The interface 127 is a contact point standard in data communication between different devices and is an electrical standard for connecting those devices. The main control unit C is connected to the ink-jet printer unit 1*a* through the interface 127, and a control signal from the main control unit C is output to the ink-jet printer unit 1*a*.

The ink-jet printer unit 1*a* includes the ink-jet head 109, a head driver 112, the transport motor 110, a transport motor driver 113, the carriage motor 111, a carriage motor driver 114, the rear edge sensor 106, and a carriage home sensor 115.

The head driver 112 is a circuit for driving the ink-jet head 109. The head driver 112 is controlled by a control signal transmitted from the main control unit C and applies the ink-jet head 109 with a drive pulse having a waveform suited to a recording mode.

The transport motor 110 is a step motor that rotates in accordance with a pulse power, and its angle of rotation changes in proportion to the number of pulses applied. The transport motor driver 113 is a circuit for driving the transport motor 110 by applying a pulse power thereto, and is controlled by a control signal transmitted from the main control unit C.

The carriage motor 111 is for operating the carriage described above, and is driven by the carriage motor driver 114. The carriage home sensor 115 is a sensor for detecting the carriage at a predetermined home position. A detection signal of the carriage home sensor 115 is input through the interface 127 to the main control unit C so that the CPU 121 can recognize whether or not the carriage is at the home position.

The detection signal of the rear edge sensor 106 is output to the main control unit C through the interface 127. The CPU 121 thus recognizes whether or not a recording sheet is at the rear edge detection position.

The main control unit C is also connected to the image scanning unit 1*b* through the interface 127. The image scanning unit 1*b* is operated based on an input from the operation panel 9 and reads an image. Image data read by the image scanning unit 1*b* is printed onto a recording sheet by the ink-jet printer unit 1*a* or sent to an external facsimile device through a communication control circuit.

Figure 11:
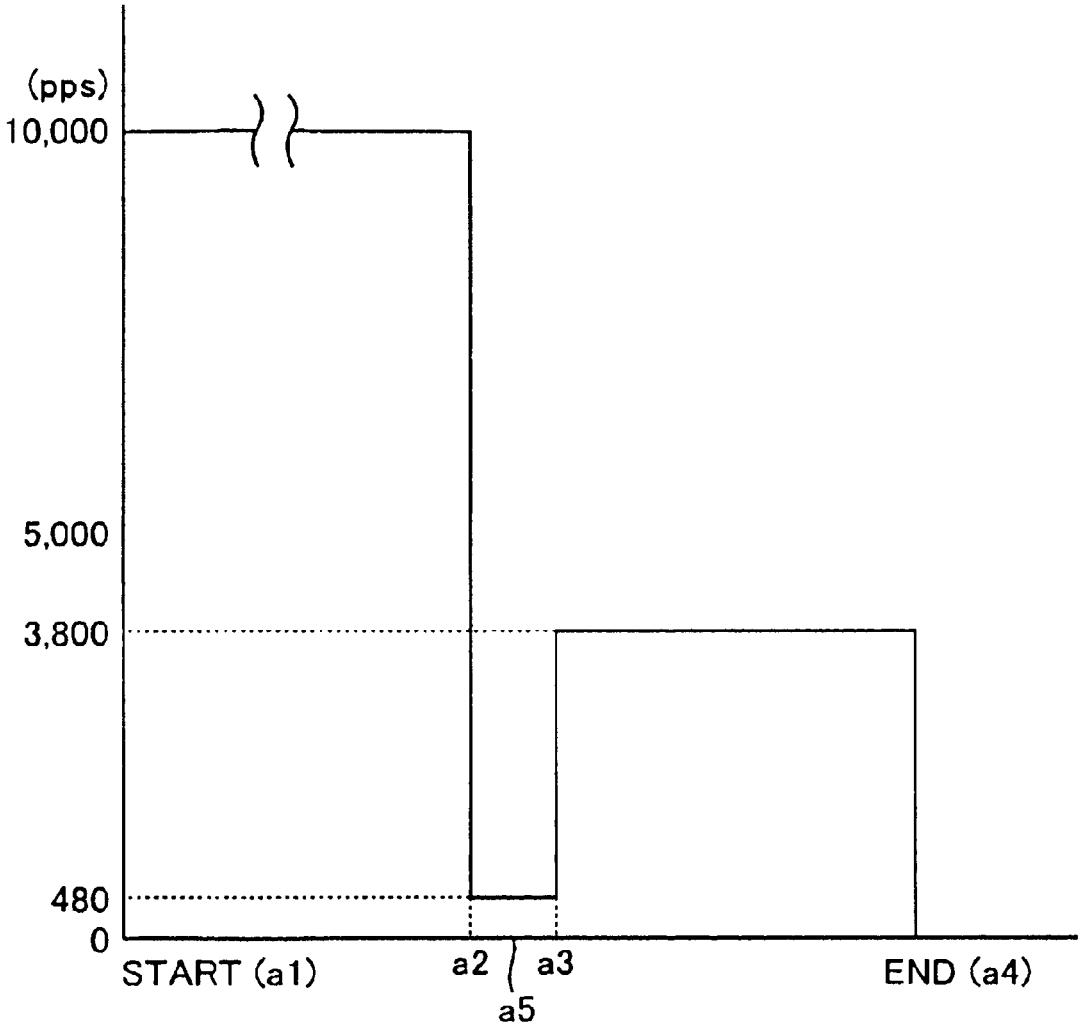
FIG. 11 is a graph showing a relationship between a position of a rear edge of a recording sheet and a sheet transport speed.

FIG. 11 shows a relationship between the position of the rear edge of a recording sheet and the transport speed of the recording sheet during a printing operation of the multi-function peripheral device 1. During the printing operation, a recording sheet is transported along the sheet feed path in the sheet transport direction Z. Usually, the recording sheet is transported by both the transport roller 101 and the sheet feed roller 103 (mainly by the transport roller 101). However, in the latter stage of the printing operation, the recording sheet is no longer sandwiched between the transport roller 101 and the pinch roller 102, and the discharge roller 103 alone transports the recording sheet. At the instant the rear edge of the recording sheet is discharged from the nip between the transport roller 101 and the pinch roller 102, there has conventionally been a problem that recording sheet is flung by the momentum, disturbing a printed image.

In the present embodiment, this problem is solved by changing the target transport speed as shown in FIG. 11. The horizontal axis shows the position of a rear edge of a recording sheet (sheet feed amount) A start point a1 is the original point where the rear edge of the recording sheet locates when a leading edge of the recording sheet is located at the nip between the transport roller 101 and the pinch roller 102. In other words, when the leading edge of the recording sheet is at the nip between the transport roller 101 and the pinch roller 102, the rear edge of the recording sheet locates at the point a1.

A point a5 is the nip point between the transport roller 101 and the pinch roller 102. In other words, the rear edge of the recording sheet has moved from the original point a1 to the nip point a5. A point a2 is 2 mm upstream (−2 mm) of the nip point a5. A point a3 is 2 mm downstream (+2 mm) of the nip point a5. An end point a4 is where the rear edge of the recording sheet is released from the nip between the discharge roller 103 and the spur 104. That is, when the rear edge of the recording sheet reaches the end point a4, then this means transport of one recording sheet has completed.

The vertical axis indicates a target rotation speed (pulse per second (pps)) of the transport motor 110.

As shown in the graph, the target rotation speed of the transport motor 110 (transport speed of the recording sheet) is set to a normal speed of 10,000 pps during when the recording sheet is transported in a normal manner by both the transport roller 101 and the discharge roller 103 or by the transport roller 101.

However, when it is detected that the rear edge of the recording sheet will reach the point a2 during a next transport of the recording sheet, then the target rotation speed of the transporting motor 110 is switched to 480 pps and maintained until it is detected that the rear edge of the recording sheet has passed the point a3. Therefore, the recording sheet is prevented from being flung by the momentum of releasing the rear edge of the recording sheet from the nip between the transport roller 101 and the pinch roller 102, maintaining high printing quality.

After it is detected that the rear edge of the recording sheet has passed the point a3, the discharge roller 103 alone transports the recording sheet. Therefore, the target rotation speed is set to 3,800 pps, which is slower than the normal speed. That is, after the rear edge of the recording sheet leaves the nip of the transport roller 101, the discharge roller 103 alone transports the recording sheet. Because the discharge roller 103 and the spur 104 sandwich the recording sheet therebetween with a weaker pressure as described above, the discharge roller 103 readily slips on the recording sheet. However, by setting the target rotation speed slower than the normal speed, it is possible to prevent the discharge roller 103 from slipping on the recording sheet.

The target rotation speeds of the transport motor 110 are not limited to the above speeds. Different speeds can be used as long as flinging of the recording sheet in the vicinity of the nip point a5 and slipping of the recording sheet after the recording sheet leaves the nip of the transport roller 101 can be prevented.

Here, in order to prevent flinging of a recording sheet, the rotation speed of the transporting roller 110 at the instant the rear edge of the recording sheet passes the nip point a5 is reduced. However, in the present embodiment, taking transport error into consideration, the rotation speed is reduced for the range between the point a2 that is 2 mm upstream of the nip point a5 and the point a3 that is 2 mm downstream thereof. Information on the points a2 and a3 is stored as setting values in the setting value memory 124*a* of the EEPROM 124 and the speed reduction range is determined based on the these setting values The setting values can be changed by a user as needed. If the setting values are changed, then the target rotation speed is changed in accordance with the changed setting values.

A thick recording sheet is flung to a greater degree. On the other hand, slippage occurs more likely when a glossy paper is used. Therefore, the speed change could be switched depending on the type of recording sheet to be used. Further, because flinging and slippage is insignificant when a standard paper is used, the speed could be kept constant when such a standard paper is used as a recording sheet.

Figure 12:
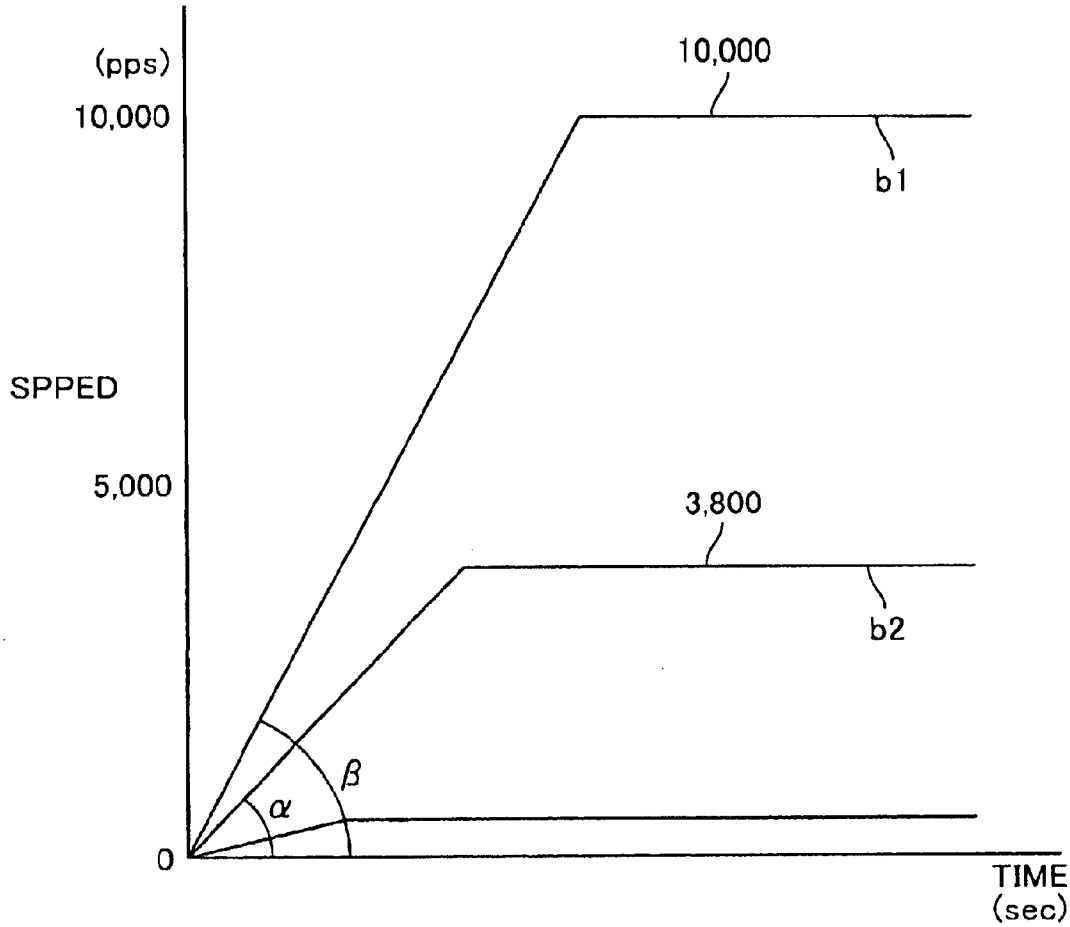
FIG. 12 is a graph showing relationships rotation speeds of a transporting motor (transport speed) and time.

FIG. 12 is a graph showing relationships between accelerations and target rotation speeds of the transport motor 110 (transport speed). The horizontal axis shows time (sec) whereas the vertical axis shows rotation speeds (pps) of the transport motor 110.

A solid line b1 indicates a normal acceleration to reach the normal speed by which a recording sheet is transported in the normal manner (by both the transport roller 101 and the sheet feed roller 103 or by the transport roller 101). A solid line b2 indicates an acceleration to reach a transport speed by which a recording sheet is transported by the discharge roller 103 only. As shown in the graph, an angle $\alpha$ of the solid line b2 is set smaller than an angle $\beta$ of the solid line b1.

When a recording sheet is transported in the normal manner, it is desirable to reach a predetermined rotation speed quickly. Therefore, greater acceleration is desired. On the other hand, when a recording sheet is transported by only the discharge roller 103 after the rear edge of the recording sheet leaves the nip, the discharge roller 103 slips more easily as the rotation speed accelerates more sharply. Therefore, in this embodiment, the acceleration of the transport motor 110 is set different between when a recording sheet is transported by the discharge roller 103 only and when a recording sheet is transported in the normal manner so as to make them suited to the respective target transport speed.

In other words, the acceleration to reach the transport speed for transporting a recording sheet by the discharge roller 103 alone is set smaller than the normal acceleration in order to prevent the discharge roller 103 from slipping.

Figure 13:
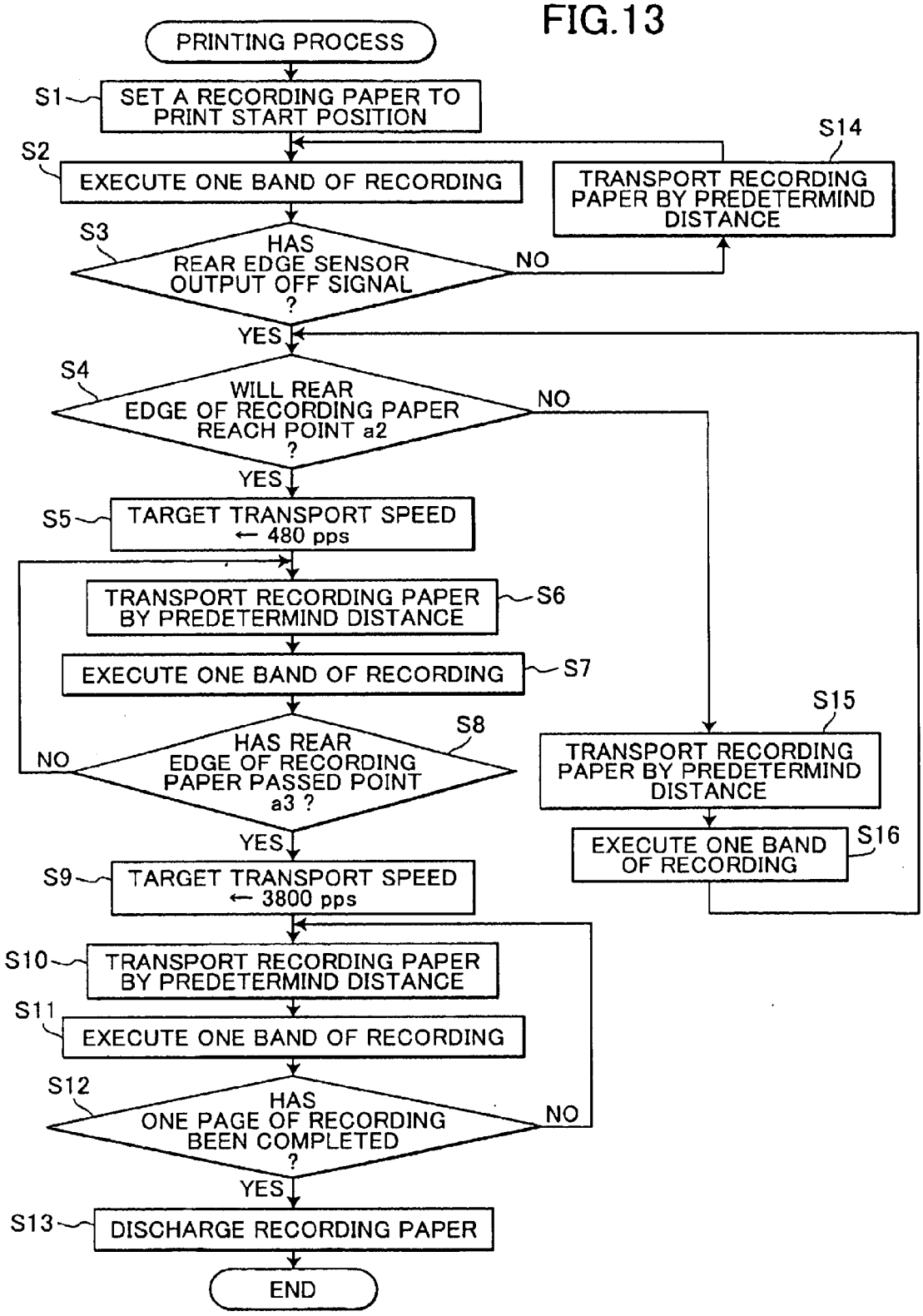
FIG. 13 is a flowchart representing a printing process according to a first embodiment of the present invention.

Next, a printing process performed in the multi-function peripheral device 1 will be described with reference to the flowchart of FIG. 13. The printing process is for printing images by using the ink-jet printer unit 1*a* based on print data read by the image scanning unit 1*b* or facsimile data received from an external device, while changing the transport speed of the recording sheet depending on a position of the rear edge of the recording sheet.

In this printing process, first a recording sheet is fed by the transport roller 101 and supplied to a predetermined print start position such that a leading end of a print area of the recording sheet is positioned beneath the ink-jet head 109 (S1). At this time, the target rotation speed of the transport motor 110 is set to a normal transport speed of 10,000 pps. Then, the ink-jet head 109 performs one-band of printing to print a single-band worth of image on the recording sheet while moving across the recording sheet in the lateral direction (S2). Then, it is determined whether or not the rear edge sensor 106 has output an OFF signal (S3). If not (S3:NO), this means that the rear edge of the recording sheet has not passed the rear-edge detection position. Therefore, the recording sheet is transported by a predetermined distance at the normal transport speed (S14). Then the process returns to S2.

On the other hand, if so (S3:YES), then this means that the rear edge of the recording sheet has passed the rear-edge detection position, and it is determined whether or not the rear edge of the recording sheet will reach (pass by) the point a2 (pass by) during a next sheet transport operation (S4).

Here, the CPU 121 measures a sheet transport amount from when the rear edge sensor 106 has output the OFF signal by counting a number of pulses of the transport motor 110. Because the recording sheet is transported by the predetermined distance each time, a transport amount by a sheet transport operation can be expressed in terms of a number of pulses of the transporting motor 101. Further, the distance of the region between the points a2 and a3 is a fixed and known value. Therefore, it is possible to calculate a position where the rear edge of the recording sheet will locate after the next sheet transport operation.

If a negative determination is made in S4 (S4:NO) then the recording sheet is transported by the predetermined distance at a set transport speed (S15). In this case, the transport speed is the normal transport speed of 10,000 pps. Then, next one-band printing is performed (S16), and the process returns to S4. On the other hand, if a positive determination is made in S4 (S4:YES), then the target transport speed is set to 480 pps (S5). The recording sheet is transported by the predetermined distance at the set transport speed (480 pps) (S6), and a next one-band printing is performed (S7). In this way, the recording sheet is prevented from being flung at the instant the rear edge of the recording sheet is released from the nip of the transport roller 101.

Then, it is determined whether or not the rear edge of the recording sheet has passed the point a3 (S8). If not (S8:NO), then the process returns to S6. On the other hand, if so (S8:YES), this means that the recording sheet is no longer nipped between the transport roller 101 and the pinch roller 102. Therefore, the target transport speed is set to 3,800 pps (S9). At this time, the sheet transport speed is accelerated from 0 pps to 3,800 pps with the acceleration smaller than the normal acceleration as shown in FIG. 12.

Then, the recording sheet is again transported by the predetermined distance at the set transport speed (S10), which is 3,800 pps in this case. One-band printing is performed (S11). It is determined whether or not printing has completed for a single page (S12). If not (S12:NO), then the process returns to S10. On the other hand, if so (S12:YES), then the discharge roller 103 is accelerated to a higher speed to discharge the recording sheet (S13), and the present process ends.

Next, a printing process according to a second embodiment will be described with referring to a flowchart of FIG. 14. In the printing process according to the above-described first embodiment, the target rotation speed is maintained 480 pps when the rear edge of the recording sheet locates within the region between the points a2 and a3 even for a short period time during a sheet transport operation. In the second embodiment, however, the target rotation speed is 480 pps only if the rear edge of the recording sheet locate within the region between the points a2 and a3 for the entire period of a sheet transport operation. Details will be described.

Figure 14:
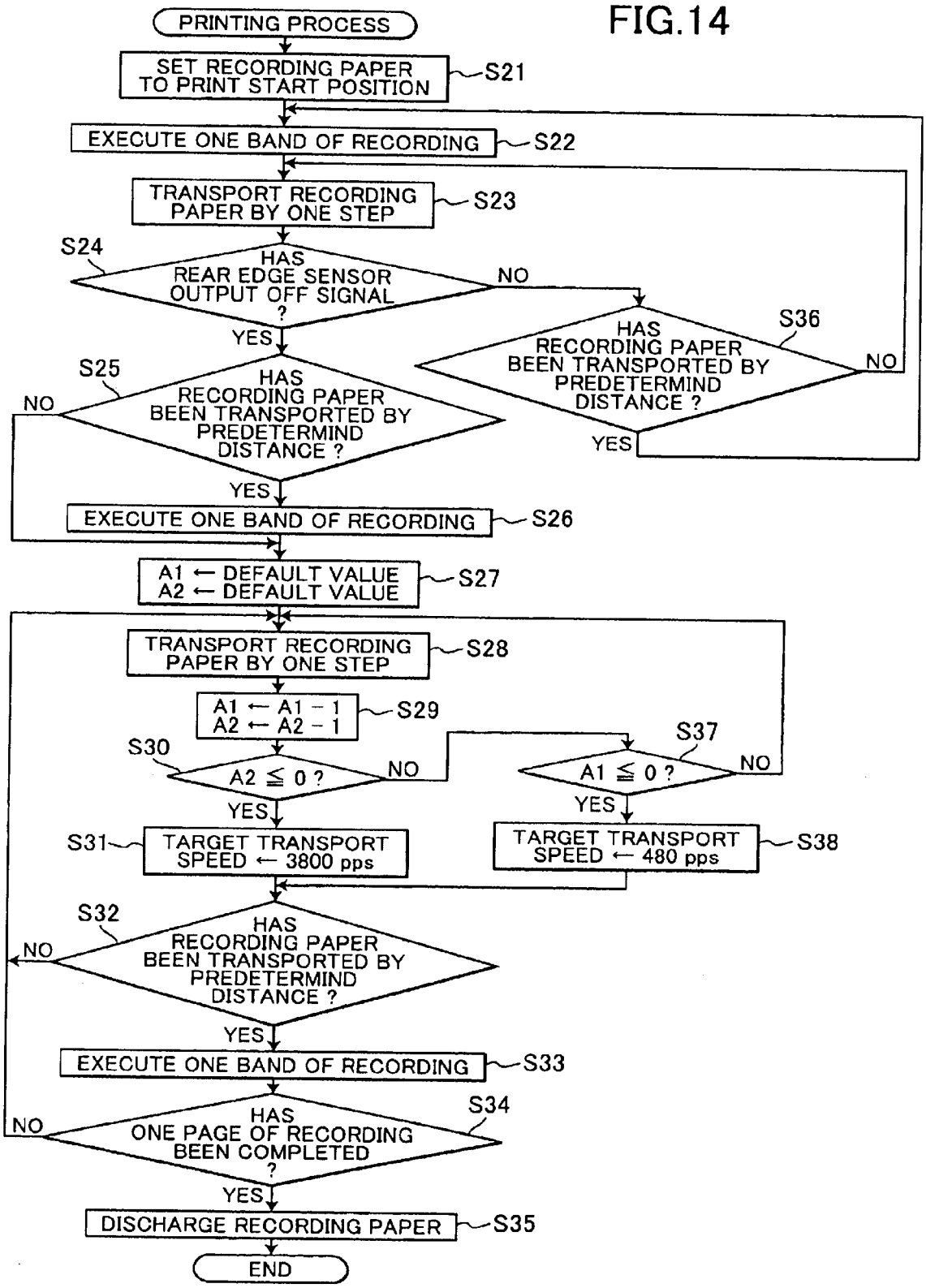
FIG. 14 is a flowchart representing a printing process according to a second embodiment of the present invention.

In FIG. 14, a recording sheet is set to a print start position (S21), and the ink-jet head 109 performs one-band printing (S22). The recording sheet is then transported by a single step (S23). Here, a single step is the minimum unit of sheet feeding of the transport motor 110.

Thereafter, it is determined whether or not the rear edge sensor 106 has output an OFF signal (S24). If not (S24:NO), then the process proceeds to S36, where it is determined whether or not the recording sheet has been transported by a predetermined distance. If not (S36:NO), the process returns to S22. If so (S36:YES), then process returns to S22.

If a positive determination is made in S24 (S24:YES) then it is determined whether or not the recording sheet has been transported by the predetermined distance (S25). If so (S25:YES), then the ink-jet head 109 performs next one-band printing (S26), and the process proceeds to S27. On the other hand, if not (S25:NO), then the process directly proceeds to S27. In S27, variables A1 and A2 are set to their respective default values. Here, the variable A1 represents a number of steps of the transport motor 110 required to transport the rear edge of the recording sheet from the rear edge detection position to the point a2. The variable A2 represents a number of steps required to transport the rear edge of the recording sheet from the rear edge detection position to the point a3.

Then, the recording sheet is transported by one step (S28), and the variables A1 and A2 are decremented by 1 (S29). It is determined whether or not the variable A2 is equal to or less than 0 (S30). If not (S30:NO), then it is determined whether or not the variable A1 is equal to or less than 0 (S37). If not (S37:NO), then the process returns to S28. On the other hand, if so (S37:YES), then this means that the rear edge of the recording sheet has reached the point a2. Therefore, the target rotation speed of the transport motor 110 is set to 480 pps (S38), and then the process proceeds to S32.

On the other hand, if a positive determination is made in S30 (S30:YES), then the target rotation speed of the transport motor 110 is set to 3,800 pps (S31). It is determined whether or not the recording sheet has been transported by the predetermined distance (S32) If not (S32:NO), then the process returns to S28. On the other hand, if so (S32:YES), then the ink-jet head 109 performs next one-band printing (S33). Then, it is determined whether or not the printing has completed for a single page (S34). If not (S34:NO), then the process returns to S28. If so (S34:YES), then the discharge roller 103 is rotated at higher speed to discharge the recording sheet (S35), and the printing process ends.

As described above, according to the printing process of the second embodiment, the reduced speed of 480 pps is maintained only for a minimum time duration, and so the printing process can be performed efficiently.

Since the reduced speed of 480 pps is maintained only for a minimum time duration in the second embodiment, the target rotation speed may be changed from 480 pps to 3,800 pps in the middle of transport operation for a predetermined distance. In such cases, the rotation speed is accelerated from 480 pps to 3,800 pps with the acceleration smaller than the normal acceleration in the similar manner as in the first embodiment.

Next, a printing process according to a third embodiment of the present invention will be described with reference to the flowchart of FIG. 15.

The ink-jet head 109 and rollers, such as the transport roller 101, are varied in size and shape due to tolerance in their manufacture. Accordingly, the transport amount with printing varies among products. This is one of the factors that lower the printing quality. The printing quality is also influenced by the type of recording sheet, such as material and thickness of the recording sheet.

In the first and second embodiments, the multi-function peripheral device 1 performs the printing process without taking into account the variation among the products. In the third embodiment, correction values regarding a sheet transport specific to the multi-function peripheral device 1 are stored in the setting value memory 124, and a sheet transport amount is corrected based on those correction values. Also, when transporting a recording sheet by the feed roller 103 in the first and second embodiment, the transport speed is reduced in order to prevent white streaks or the like from appearing in printed images. In the third embodiment, change in transport speed (transport amount) is corrected depending on the type of a recording sheet. Here, the correction of transport amount is achieved through adjustment of the drive amount (the number of applied pulses) of the transport motor 110.

According to the third embodiment, the setting value memory 124*a* further stores correction values T1 and T2. The correction value T1 is a correction value for the transport roller 101, and the correction value T2 is a correction value for the discharge roller 103. Both the correction values T1 and T2 are determined by the shape of each member which is measured prior to shipment or by a difference between an actual transport amount and a theoretical transport amount. The setting value memory 124*a* also stores correction values for correction according to the type of recording sheet.

Specifically, the correction value T1 is a number of pulses indicating the difference between a number of pulses theoretically required to transport a recording sheet by one inch and a number of pulses actually required by the transport roller 101 to transport the recording sheet by one inch. The correction value T2 is a number of pulses indicating the difference between a number of pulses theoretically required to transport a recording sheet by one inch and a number of pulses actually required by the discharge roller 103 to transport the recording sheet by one inch. These correction values T1 and T2 fall between −3 pulses and +3 pulses. The correction value T is set for each type of recording sheet and is a number of pulses indicating the difference between a number of pulses to transport a normal sheet and a number of pulses to transport a coated paper or a glossy paper.

Components identical with those of the multi-function peripheral device 1 in the first embodiment are denoted by the same reference numerals and explanations thereof will be omitted.

FIG. 15 shows the flowchart representing the printing process according to the present embodiment. In this printing process, first, it is determined whether or not a recording sheet to use is a coated paper (S41). If so (S41:YES), then the process proceeds to S45, where a correction value T is set to 1, and the process proceeds to S46. If not (S41:NO), then it is determined whether or not the recording sheet is a glossy paper (S42). If so (S43:YES), then the correction value T is set to 2 (S43), and the process proceeds to S46. If not (S42:NO), then this means that the recording sheet is a normal sheet, and the correction value T is set to 0 (S44). Then, the process proceeds to S46. Note that OHP sheet could be also used. In this case, the correction value T is the same as for the glossy paper, which is 2 in this embodiment.

In S46, the recording sheet is set to a print start position. Then, in S47, a correction pulse number L2 is set to the sum of the correction value T1 and the correction value T (L2=T1+T), and also a pulse number L is set to ((1+L2/L0)×L1). Here, L0 is a number of pulses required to transport a recording sheet by one inch, and L1 is a number of pulses required for an ideal rollers to transport a recording sheet by the predetermined distance.

Next, one band printing is performed (S48), and the recording sheet is transported by one step (S49). It is determined whether or not the recording sheet has been transported by P-number of steps after the rear edge sensor 106 has output an OFF signal (S50). Here, the P-number of steps is required to transport the recording sheet to the nip point of the transport roller 101 after the rear end sensor 106 has output the OFF signal. If not (S50:NO), then it is determined whether or not the recording sheet has been transported by L-number of pulses (S61). If so (S61:YES), then the process returns to S48. If not (S61:NO), the process returns to S49.

If a positive determination is made in S50 (S50:YES) then the pulse number L is set to (L3/L0×(T1+T)+(L1−L3)/L0×(T2+T)+L1) (S51) Here, L3 is a number of remaining steps, that is, a difference between P and a number of steps by which the recording sheet has been transported after the rear edge sensor 106 has output the OFF signal.

Then, it is determined whether or not the recording sheet has been transported by L-number of pulses (S52). If not (S52:NO), then the recording sheet is transported by one step, and the process returns to S52. If so (S52:YES), then the correction pulse number L2 is set to the sum of the correction value T2 and the correction value T (L2=T2+T) and also the pulse number L is set to ((1+L2/L0)×L1) (S53) That is, the discharge roller 103 alone transports the recording sheet after the rear edge has left the nip point, the pulse number L is changed for a value suitable for the sheet transport by the discharge roller 103 only. One band printing is performed (S55), and the recording sheet is transported by one step (S56).

It is determined whether or not the recording sheet has been transported by L-number of pulses (S56). If not (S56:NO), then the process returns to S55. If so (S56:YES), then it is determined whether or not a printing has been completed for a single page (S57). If not (S57:NO), then the process returns to S54. If so (S57:YES), then the recording sheet is discharged (S58). It is determined whether or not the printing has been completed for all pages (S59). If not (S59:NO), then the process returns to S46. On the other hand, if so (S59:YES), then the process ends.

Note that each of the correction values and transport amount obtained from calculation in this embodiment is rounded to an integer. Also, a process similar to that of the first and second embodiments could be used in the third embodiment. For example, a target rotation speed is set to 10,000 pps (S49), and this value is maintained until immediately before the rear edge of the recording sheet leaves the nip point of the transport roller 101, where the target rotation speed is changed to 480 pps (S49, S61). The target rotation speed of 480 pps is maintained until the rear edge of the recording sheet is determined to have left the nip point (S50:YES). Then, the target rotation speed is changed to 3,800 pps (S61). In this manner, it is possible to prevent the recording sheet from being flung by the momentum of releasing the rear edge of the recording sheet from the nip between the transport roller 101 and the pinch roller 102.

In this manner, the multi-function peripheral device 1 controls a sheet transport based both on correction values specific to the device 1 and on the type of recording sheet to be used. Therefore, the multi-function peripheral device 1 can provide a high-quality printed material to users.

Figure 16:
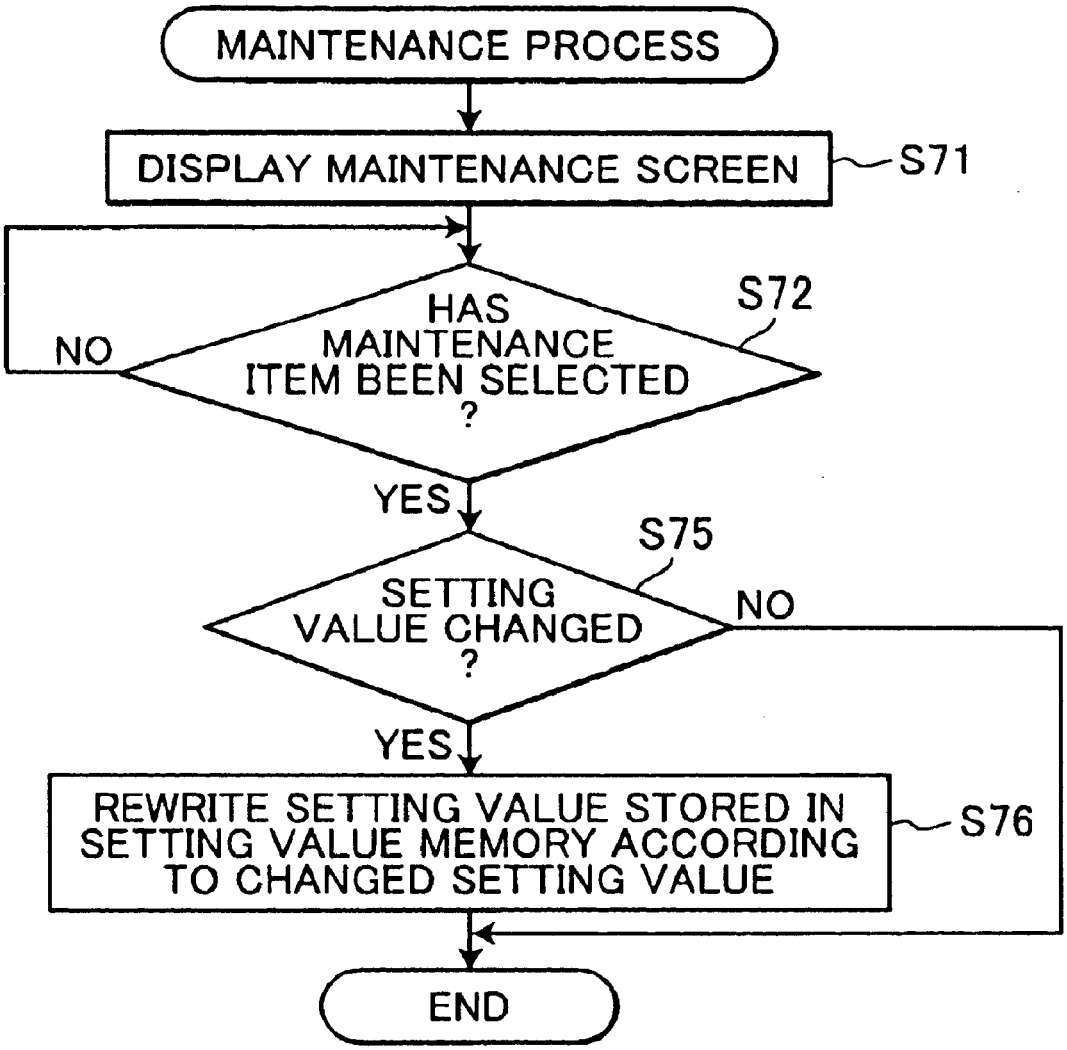
FIG. 16 is a flowchart representing a maintenance process according to the third embodiment of the present invention.
Figure 17:
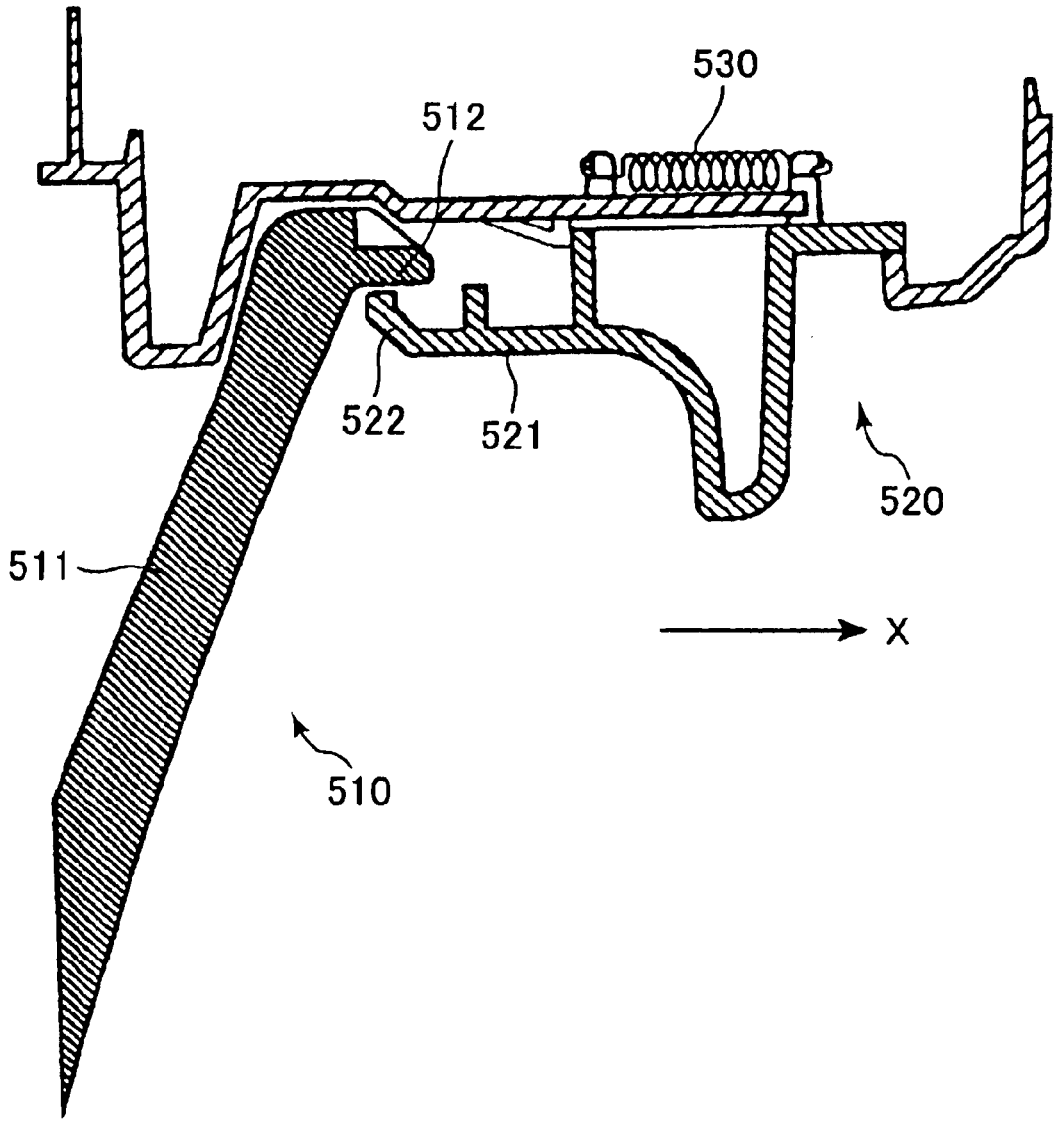
FIG.17 RELATED ART
FIG. 17 is an enlarged cross-sectional side view of a hook body and a lever of a conventional multi-function peripheral device.

FIG. 16 shows the flowchart representing a maintenance process executed in the multi-function peripheral device 1 according to the third embodiment. This maintenance process is to change correction values T1 and T2 stored in the setting value memory 124*a*. Although the correction values T1 and T2 have already been set and stored prior to shipment, these correction values T1 and T2 may not work well depending on the installation status of the multi-function peripheral device 1. In such case, the correction values T1 and T2 are changed through the maintenance process for better correction.

The maintenance process is started when a user operates on the operation panel 9. Once the process starts, first a maintenance screen is displayed on the LCD 200, prompting a user to input a maintenance item (S71). It is determined whether of not the user has selected a desired item (S72). If not (S72:NO), then the process waits until a positive determination is made. If so (S72:YES), then it is determined whether or not it is necessary to change the correction value T1 and/or T2 (S75). If not (S75:NO), then the process ends. On the other hand, if so (S75:YES), then the correction value T1 and/or T2 is overwritten, and the process ends.

While some exemplary embodiments of this invention have been described in detail, those skilled in the art will recognize that there are many possible modifications and variations which may be made in these exemplary embodiments while yet retaining many of the novel features and advantages of the invention.

For example, a pulse motor is used as the transporting motor 110 in the above embodiments. However, an encoder could be used as a DC motor to control a transport speed.

What is claimed is:

1. An image forming device comprising:

a main body;

a cover body that is pivotally supported on the main body, wherein the cover body pivotally moves between a closing position and an opening position;

a first engagement member provided to the main body;

a second engagement member that is slidably attached to the cover body, the second engagement member being detachably engageable with the first engagement member; and an urging member that urges the second engagement member toward the main body when the cover body is at the closing position, wherein:

when the cover body is at the closing position, the second engagement member is movable with respect to the main body between at least a contact position and an engagement position, the second engagement member at the contact position confronts the first engagement member, and the second engagement member at the engagement position engages the first engagement member; and the second engagement member moves from the contact position to the engagement position when the second engagement member slides away from the main body.

2. The image forming device according to claim 1, wherein the first engagement member and the second engagement member at the contact position hardly define a gap therebetween.

3. The image forming device according to claim 1, wherein the second engagement member at the contact position contacts the first engagement member.

4. The image forming device according to claim 1, wherein the second engagement member at the contact position comes into engagement with the first engagement member at the engagement position when the second engagement member slides away from main body while being pulled upward with respect to the main body, and the first engagement member prevents the second engagement member at the engagement position from moving further away from the main body, thereby maintaining the cover body at the closing position.

5. The image forming device according to claim 4, wherein the second engagement member at the contact position moves to a release position when the cover body slides away from the main body without being pulled upward with respect to the main body, the second engagement member at the release position allowing the cover body to pivot upward with respect to the main body to the opening position.

6. The image forming device according to of claim 1, wherein:

one of the first engagement member and the second engagement member has a projection; and another one of the first engagement member and the second engagement member has an engagement portion for engaging the projection and a flat surface, the engagement portion being one of a concave portion and a hole portion formed with an engagement hole; and when the second engagement member is at the contact position, the projection confronts the flat surface.

7. The image forming device according to claim 6, wherein:

the one of the first engagement member and the second engagement member has at least two projections;

the another one of the first engagement member and the second engagement member has at least two engagement portions; and the another one of the first engagement member and the second engagement member has a reinforcement member disposed between the at least two engagement portions, the reinforcement member reinforcing the at least two engagement portions.

8. The image forming device according to claim 1, wherein the cover body has a protruding portion to which the second engagement member is attached, the protruding portion protruding outwardly from a side of the main body.

9. The image forming device according to claim 1, wherein the first engagement member disposed at a position retracting from a side of the main body.

10. The image forming device according to claim 1, further comprising an image reading unit mounted on the cover body for reading an image from original, and a printing unit mounted on the main body for printing images onto a recording medium.

* * * * *